United States Patent [19]

Snijders

[11] Patent Number: 4,850,544

[45] Date of Patent: Jul. 25, 1989

[54] YARN METERING BOBBIN

[75] Inventor: Willibrordus M. Snijders, CX Deurne, Netherlands

[73] Assignee: Sulzer Brothers Limited, Winterthur, Switzerland

[21] Appl. No.: 125,247

[22] Filed: Nov. 25, 1987

[30] Foreign Application Priority Data

Dec. 17, 1986 [CH] Switzerland ..... 05028/86

[51] Int. Cl.[4] ..... B65H 51/20

[52] U.S. Cl. ..... 242/47.01; 66/132 R; 139/452; 242/110.1

[58] Field of Search ..... 242/47.01, 47.08, 47.09, 242/47.1, 47.11, 47.12, 47.13, 110, 110.1; 139/450, 452; 66/132 R

[56] References Cited

U.S. PATENT DOCUMENTS

| | | | |
|---|---|---|---|
| 1,443,336 | 1/1923 | Atwood | 242/110.1 |
| 3,243,975 | 4/1966 | Lawson et al. | 242/47.01 X |
| 4,227,657 | 10/1980 | Simin et al. | 242/47.01 |
| 4,239,066 | 12/1980 | Takahashi | 242/47.01 X |
| 4,278,112 | 7/1981 | Takahashi | 242/110.1 X |
| 4,369,818 | 1/1983 | Yoshida | 242/47.09 X |

FOREIGN PATENT DOCUMENTS

| | | | |
|---|---|---|---|
| 557662 | 5/1923 | France | 242/110.1 |
| 122031 | 8/1927 | Switzerland | 242/110.1 |

*Primary Examiner*—Stanley N. Gilreath
*Attorney, Agent, or Firm*—Kenyon & Kenyon

[57] ABSTRACT

The yarn metering drum has a plurality of radially moveable segments, a pair of edge discs at the longitudinal ends of the segments and elements disposed of the longitudinal ends of the segments which are spaced apart a distance less than the length of a base of a segment in order to define a winding zone of the drum. The elements may be made integral with the edge discs or with the radially moveable segments. The elements prevent damage to the yarn by preventing the yarn from winding behind or below the segments.

15 Claims, 3 Drawing Sheets

YARN METERING BOBBIN

This invention relates to a yarn metering bobbin. More particularly, this invention relates to an adjustable yarn metering bobbin.

Heretofore, various types of yarn metering bobbins have been known which have a drum comprised of a number of radially movable segments which can be moved so as to change the effective diameter of the bobbin. Bobbins of this kind are used, for example, to draw weft yarn off a weft bobbin and to adjust weft yarn length to looms by yarn reserves of equal length being supplied continuously per unit of time to a store from which the weft yarn is picked intermittently by a picking element, such as an air jet, at the picking rhythm into a warp yarn shed.

Advantageously, the length of the yarn reserve and, therefore, often too the speed of the yarn delivery of the metering bobbin are variable. This is because a single loom is often used to produce fabrics of different widths. Furthermore, looms may operate on the same weaving width but at varying speeds, i.e. varying the number of picks per unit of time, in dependence, for example, upon the particular kind of cloth being produced. It has also been conventional to use yarn metering bobbins where the diameter, i.e. periphery, can be varied and which are driven by a main drive of the loom by way of a fixed-ratio transmission. By changing the diameter of the metering bobbin, which is also known as a winding drum or spreading roll, the weft yarn length can be adjusted.

U.S. Pat. No. 4,227,657 describes a variable diameter yarn metering bobbin in which the drum or roller or the like or a flexible strip forming a winding surface can be moved in spiral grooves of two edge discs at the ends of the drum. However, in this construction, the wound-on-yarn may enter the grooves with the possible risk of yarn breakages and of the yarn being wound below and behind the drum. Also, relatively costly fabrication steps are required in order to insure that the two edge discs are aligned correctly relative to one another as regards their angle of rotation. Still, further the friction operative between the drum and the groove walls makes accurate adjustment of the winding periphery relatively difficult and time consuming.

German Pat. No. 2,928,382 describes a spreading roll which has a cumbersome screwthreaded spindle construction. In addition, a yarn may enter a gap between the edge discs and the drum elements, with the risk of yarn breakages and of improper yarn winding.

Swiss Pat. No. 638,843 describes a winding drum in which drum-forming round rods are moved radially in circularsegment grooves in a pair of edge discs by means of a geared transmission in each such disc. However, this construction is mechanically complex, calls for the use of round rods as drum elements and, since the winding takes on a pronounced polygonal shape, at high winding speeds, is responsible for the yarn being drawn off the supply bobbin unevenly with the consequent risk or yarn breakages. Further, an uneven draw-off and an associated alternate stressing of the yarn, associated with high stress peaks, may impair the accuracy of measurement, i.e. the accuracy of the length of weft yarn delivered by the metering bobbin.

Accordingly, it is an object of the invention to provide a relatively simple construction for a yarn metering bobbin of variable diameter.

It is another object of the invention to avoid the risk of an improper winding of a yarn on a variable yarn metering bobbin.

It is another object of the invention to provide for for a uniform yarn draw-off from a yarn metering bobbin.

It is another object of the invention to provide for accurate draw-off of yarn lengths from a yarn metering bobbin of variable construction.

Briefly, the invention provides a yarn metering bobbin which is comprised of a plurality of radially movable segments disposed about a longitudinal axis with each segment having a base parallel to the axis to define a yarn winding receiving surface. In addition, means are disposed at opposite longitudinal ends of the segments to define a winding zone therebetween of less width than the longitudinal length of a base of a respective segment. In addition, the bobbin has a pair of edge discs which are disposed at opposite longitudinal ends of the segments to define a drum therewith. With a metering bobbin of this kind, all the segments which form the drum can be moved radially just by releasing, turning and retightening, for example, a single adjusting or clamping disc so that the drum periphery can be adapted to the particular length required.

The means to define the reduced winding zone includes a radially disposed array of elements at each longitudinal end of the segments. These elements may be integral with a respective segment or may be integral with a respective edge disc to project radially outwardly of the movable segments.

Where the elements are integral with the segments, at least one edge of the edge discs may be provided with a covering over one of the elements.

Further, a resilient covering may be provided on each base of a segment for receiving yarn windings thereon. Further, the resilient covering may be mounted on a support which, in turn, is removably mounted on a respective base so as to be replaced from time to time.

The winding-defining elements near the edge discs ensure that the yarn cannot wind behind or below the yarn metering bobbin.

These and other objects and advantages of the invention will become more apparent from the following detailed description taken in conjunction with the accompanying drawings wherein.

Figure 1:
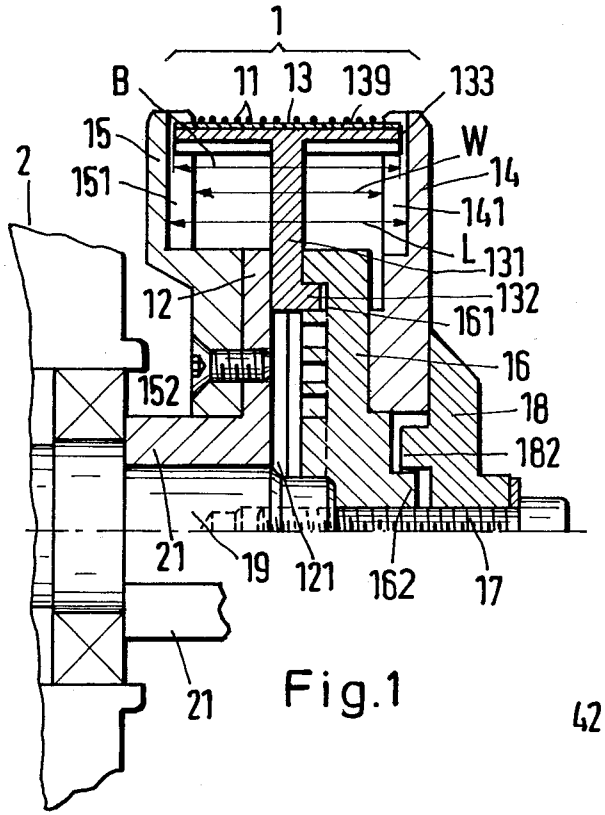
FIG. 1 illustrates a cross-sectional view through a yarn-metering bobbin constructed in accordance with the invention.

Referring to FIG. 1, the yarn metering bobbin 1 is driven by way of a tubular member 21 having a flange 12 and which is disposed on a shaft 19 of a motor 2. The drive can be taken directly by way of gearing from the main motor of a loom (not shown). The bobbin 1 is constructed of a plurality of radially moveable segments 13 which are disposed about a common longitudinal axis and which cooperate with a pair edge discs 14, 15 at opposite longitudinal ends to define a drum.

As indicated in FIG. 1, each segment 13 is of T-shape having a base 133 parallel to the axis of rotation in order to define a yarn winding receiving surface for the windings of a yarn 11. In addition, each segment 13 has a radially inwardly directed projection 131 having a lateral guide cam 132. A rotatable disc 16 is also provided between the discs 14, 15 about the common axis. This disc 16 has a spiral groove 161 for engaging with the cam 132 of each segment 13 and the opposite side of the projection 131 of each segment 13 is guided radially in grooves 121 in the flange 12. By rotating the disc 16, the segments 13 may be moved radially in response thereto.

Figure 4:
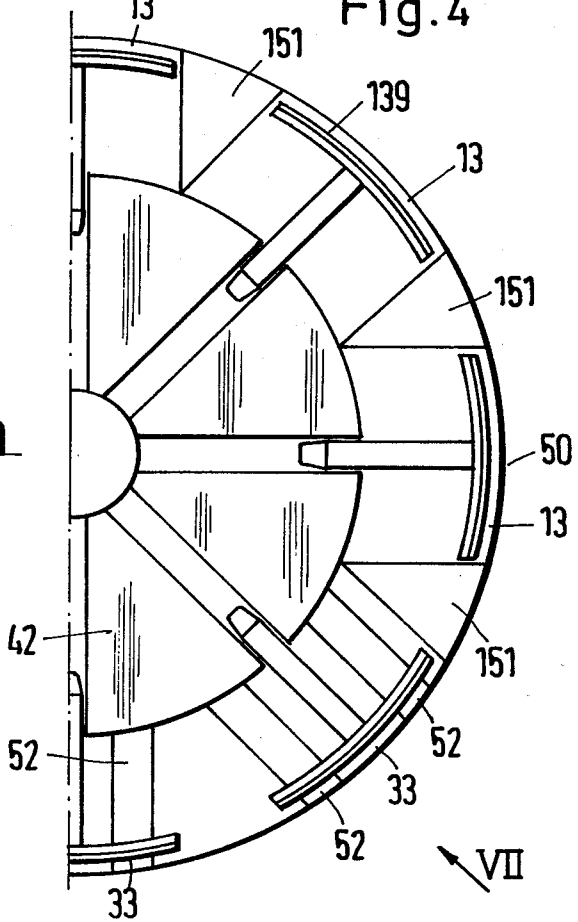
FIG. 4 illustrates a plan view of a part of an edge disc having two different kinds of yarn defining elements and radially adjustable segments.

Referring to FIG. 1, the bobbin 1 is also provided with means in the form of pairs of elements 141, 151 at opposite longitudinal ends of the segments 13 and specifically the bases 133 of the segments 13 to define a winding zone "W" of less width than the longitudinal length "B" of a base 133 of a respective segment or the gap "L" between the edge discs 14, 15. As indicated in FIG. 4, the elements 151 are disposed in a radial array and are integral with the respective edge disc 15 with each pair of circumferentially disposed elements 151 slidably guiding a respective segment 13 therebetween.

Referring to FIG. 1, a central screw-threaded pin 17 is threaded into the front of the drive shaft 19 to press a clamping disc 18 axially onto the edge disc 14 and adjusting disc 16. When the pin 17 is tightened, the projection 131 of each segment is clamped fast between the flange 12 and disc 16. The edge disc 15 is connected to the flange 12, for example by a plurality of screws 152 only one of which is shown.

In the illustrated embodiment, the segments 13 are shifted radially and, therefore, the periphery of the bobbin is altered by rotation of the disc 16. This can be readily accomplished after the pin 17 has been loosened.

The clamping disc 18 may have, for example, an elliptical ring 182 and the disc 16 may have an elliptical ring 162 in engagement with each other for transmitting rotations of the disc 18 to the disc 16. Through the agency of the spiral groove 161 and of the cams 132 guided therein, this rotation of the disc 16 initiates and determines the radial movement and positioning of the segments 13. When the yarn metering bobbin is in the required position, the pin 17 is tightened. Thus, the parts of the bobbin are once again so engaged with one another as to co-rotate. If the groove 161 is spiral the projections 131 of the segments 13 are of different lengths so that the generated parts or segment bases 133 form a cylindrical drum.

Figure 2:
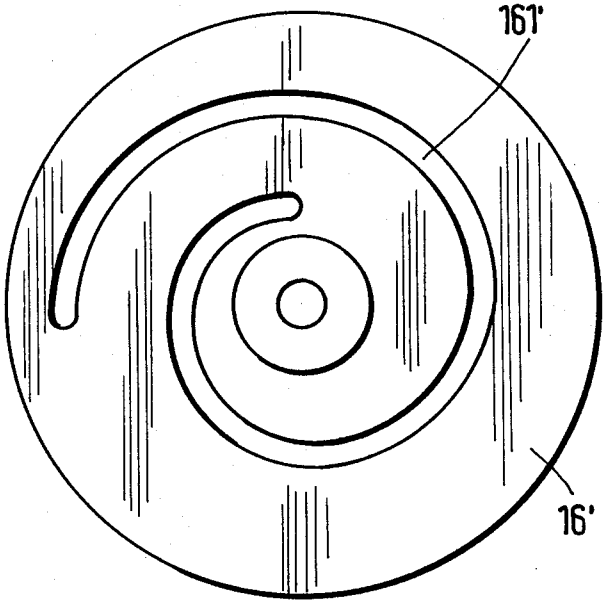
FIG. 2 illustrates an adjusting disc for adjusting the segments of the bobbin radially.

Referring to FIG. 2, the adjusting disc 16' may be formed with a spiral groove 161' having a larger radius of curvature than the groove 161 shown in section. The range of adjustment or rotation which can be provided by this disc 16' with this kind of spiral groove is limited to about 90°.

Figure 3:
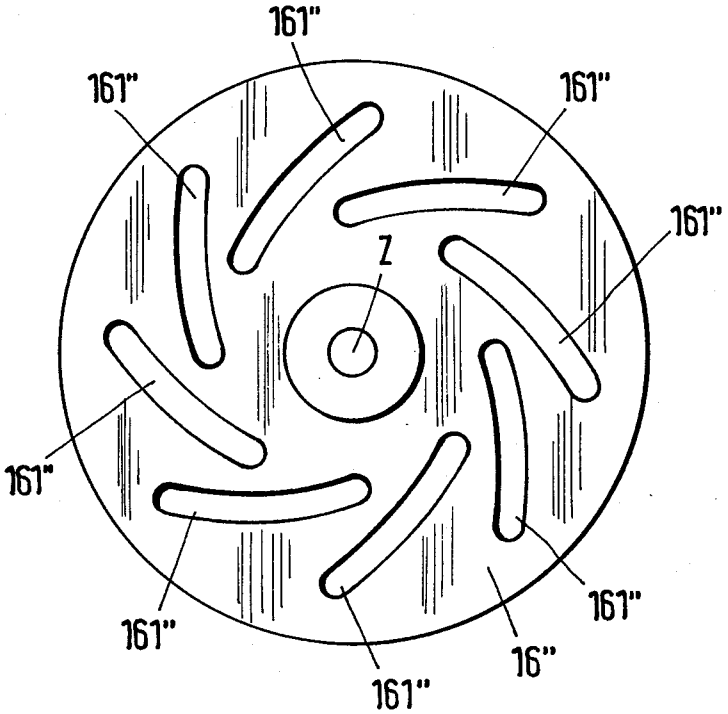
FIG. 3 illustrates a modified adjusting disc for adjusting the segments of the bobbin of FIG. 1 radially.

Referring to FIG. 3, the adjusting disc 16" has a plurality of curved grooves 161" e.g. eight, arranged symetrically around a center Z, for receiving a respective cam of a respective segment. The use of the disc 16" enables segments to be used which have the same length of projection 131.

Figure 7:
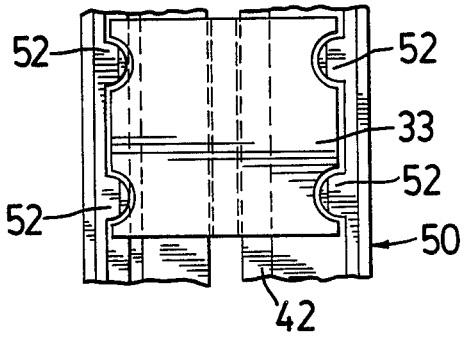
FIG. 7 illustrates a view taken in the direction of arrow VI of FIG. 4.

Referring to FIG. 4, the bobbin may be modified to have a flange 42 with an edge disc 50. In addition, two different kinds of winding-defining elements 151, 52 may be used as elements for guiding the segments 13, 33 radially. In this example, the elements 151, 52 are integral with the edge disc 50. The elements 151 extend between two segments 13 into the winding space whereas the elements 52 engage in recesses as illustrated in FIG. 7 in segment bases of the segments 33. The elements 52 have the shape, for example, of hemicylinders.

The second edge disc (not shown) also has winding-defining elements. As a rule, a particular kind of winding-defining element is used for a particular kind of yarn-metering drum.

Of note, FIG. 4 shows, purely for the sake for simplicity, two different examples of segments and winding-defining elements on a single edge disc. In practice, a single kind of winding-defining element is used for a single yarn metering bobbin. Both constructions so define the segment-constructed winding member laterally that the yarn cannot become jammed or wind behind or below the winding member.

Figure 5:
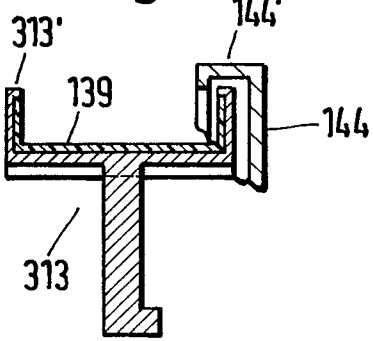
FIG. 5 illustrates a part cross-sectional view of a segment provided with a resilient covering for receiving yarns thereon.

Referring to FIG. 5, the winding-defining elements may be made integral with a respective segment by being formed as lateral flanks 313' of the segment 313. A yarn metering bobbin constructed from such segments inherently prevents the yarn from winding on behind the drum. As a further protection against yarn damage, the edge disc 144 which replaces the edge disc 14 may have a covering 144' over one of the winding-defining elements 313'. A similar disc is on the other side of the element 313 in lieu of the disc 15.

Further, as indicated in FIG. 5, a resilient covering 139 made of a rubber-like, yarn-friendly material can be provided on the base or winding surface of the segment 313. Similar coverings 139 are also known in the segments of FIGS. 1 and 4.

Figure 6:
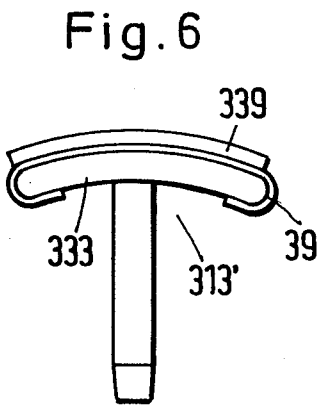
FIG. 6 illustrates a side view of a segment having a removably mounted resilient covering thereon.

Referring to FIG. 6, each segment 313 may be provided with a support 39, for example a metal carrier or plate, which is removably from the base 333 and which has a resilient covering 339 thereon. This construction permits replacement of a worn covering 339 from time to time.

The invention thus provides a yarn metering bobbin of variable construction wherein the risk of yarn breakages and the risk of yarn being wound below and behind the drum is reduced if not eliminated. Further, the invention provides a yarn metering bobbin which is to draw-off yarn in a uniform manner and which ensures accurate lengths of wet yarn being drawn off from the bobbin.

What is claimed is:

1. A yarn-metering bobbin comprising a plurality of radially movable segments disposed about a longitudinal axis, each said segment having a base parallel to said axis to define a yarn-winding receiving surface and a radial inwardly directed projection having a guide cam thereon;

a pair of edge discs, said discs being disposed at opposite longitudinal ends of said segments and said yarnwinding receiving surfaces to define a drum therewith;

at least one pair of elements disposed at longitudinal ends of said segments, said elements being spaced apart longitudinally of said axis a distance less than the longitudinal length of said yarn winding receiving surface of a segment adjacent thereto to define a winding zone of said drum; and a rotatable disc on said axis having at least one guide groove engaging with said cams for adjusting said segments radially in response to rotation of said rotatable disc.

2. A yarn-metering bobbin as set forth in claim 1 wherein said elements are integral with a respective segment.

3. A yarn-metering bobbin as set forth in claim 1 wherein each said element is integral with a respective edge disc and projects radially outwardly of said segments.

4. A yarn-metering bobbin as set forth in claim 1 said elements are integral with a respective segment and at least one of said edge discs has a covering over one of said elements.

5. A yarn-metering bobbin as set forth in claim 1 wherein each said element is radially disposed and guides at least one segment radially thereon.

6. A yarn-metering bobbin as set forth in claim 1 wherein said guide groove is a spiral groove.

7. A yarn-metering bobbin as set forth in claim 1 wherein said rotatable disc has a single spiral groove engaging with each cam of each segment.

8. A yarn-metering bobbin as set forth in claim 1 wherein said rotatable disc has a plurality of curved grooves for receiving a respective cam of a respective segment.

9. A yarn-metering bobbin as set forth in claim 1 which further comprises a resilient covering on each base of a respective segment.

10. A yarn-metering bobbin as set forth in claim 9 which further comprises a support removable mounted on a respective base and having said resilient covering thereon.

11. In a yarn-metering bobbin, the combination comprising a pair of edge discs;

a plurality of radially movable segments disposed about a longitudinal axis and extending between said discs to define a drum, each said segment having a base parallel to said axis to define a yarn-winding receiving surface;

a radial array of elements on each disc disposed in alternating manner with opposite longitudinal ends of said segments to define a winding zone therebetween of less width than said yarn winding receiving surface of a respective segment; and means between said discs and within a plane of said winding zone for slidably moving said segments between respective pairs of said elements.

12. The combination as set forth in claim 11 wherein said means includes a rotatable disc on said axis with a guide groove therein and a cam on each segment slidably mounted in said groove.

13. A yarn-metering bobbin comprising a plurality of radially movable segments disposed about a longitudinal axis, each said segment being of T-shape with a base parallel to said axis to define a circumferentially elongated plate-like yarn-winding receiving surface and a radially inwardly directed projection;

a pair of edge discs, said discs being disposed at opposite longitudinal ends of said yarn receiving surfaces of said segments to define a drum therewith;

a radial array of elements disposed at longitudinal ends of said segments, each said array being spaced apart longitudinally of said axis a distance less than the longitudinal length of a base of a segment adjacent thereto to define a winding zone of said drum; and means between said edge discs for engaging with each projection of said segments for adjusting said segments radially.

14. The combination as set forth in claim 13 wherein each pair of circumferentially disposed elements of each array slidably guides a respective segment therebetween.

15. A yarn-metering bobbin as set forth in claim 13 wherein each radial projection has a lateral guide cam and said means includes a rotatable disc on said axis having at least one guide groove engaging with said cam for adjusting said segments radially in response to rotation of said rotatable disc.

* * * * *